US008986052B2

(12) United States Patent
Kim

(10) Patent No.: US 8,986,052 B2
(45) Date of Patent: Mar. 24, 2015

(54) CONNECTING TERMINAL FOR STORAGE BATTERY

(71) Applicant: Chang Hwan Precision Terminal Co., Ltd., Dangjin-gun (KR)

(72) Inventor: Hwan Chang Kim, Yongin-si (KR)

(73) Assignee: Chang Hwan Precision Terminal Co., Ltd., Dangjin-Gun (KR)

( * ) Notice: Subject to any disclaimer, the term of this patent is extended or adjusted under 35 U.S.C. 154(b) by 0 days.

(21) Appl. No.: 13/740,626

(22) Filed: Jan. 14, 2013

(65) Prior Publication Data

US 2014/0134895 A1 May 15, 2014

(30) Foreign Application Priority Data

Nov. 15, 2012 (KR) ..... 10-2012-0129473

(51) Int. Cl.
*H01R 4/42* (2006.01)
*H01R 11/28* (2006.01)

(52) U.S. Cl.
CPC ..... *H01R 11/283* (2013.01); *H01R 11/281* (2013.01)
USPC ..... 439/762

(58) Field of Classification Search
USPC ..... 439/762, 763, 764, 883, 879
See application file for complete search history.

(56) References Cited

U.S. PATENT DOCUMENTS

| | | | | |
|---|---|---|---|---|
| 3,739,322 | A * | 6/1973 | Haegert | 439/764 |
| 5,851,129 | A * | 12/1998 | Matsunaga et al. | 439/764 |
| 2014/0134896 | A1* | 5/2014 | Kim | 439/762 |

FOREIGN PATENT DOCUMENTS

| | | |
|---|---|---|
| KR | 10-0821591 | 4/2008 |
| KR | 10-0821595 | 4/2008 |
| KR | 20-0442760 | 12/2008 |
| KR | 10-1188637 | 9/2012 |

* cited by examiner

*Primary Examiner* — Phuong Dinh
(74) *Attorney, Agent, or Firm* — Harness, Dickey & Pierce, P.L.C.

(57) ABSTRACT

In a storage battery connection terminal comprising: an insertion unit of a cylindrical shape with an open end; a clamping unit for adjusting a diameter of the insertion unit by adjusting a gap between a pair of elastic plates; and a power withdrawal connecting a connection terminal, wherein the insertion unit, the elastic pieces of the clamping unit and the power withdrawal unit are formed in one piece through a forging process, the power withdrawal unit is connected at a position spaced apart from a lower portion of the insertion unit by a predetermined distance, in which a hole for inserting the connection bolt having a head of a rectangular panel shape is formed, and a resting groove with an open side is formed on a bottom surface so that a portion of the head of the connection bolt can be rest.

12 Claims, 9 Drawing Sheets

CONNECTING TERMINAL FOR STORAGE BATTERY

CROSS-REFERENCE TO RELATED APPLICATION

This application claims the benefit and priority of Korean Patent Application No. 10-2012-0129473, filed Nov. 15, 2012. The entire disclosure of the above application is incorporated herein by reference.

BACKGROUND OF THE INVENTION

1. Field of the Invention

The present invention relates to a storage battery connection terminal for connecting a storage battery of a vehicle to a connection terminal, and particularly, to a storage battery connection terminal manufactured in a forging method, in which a clamping nut is coupled from an inclined or top direction, not a lateral direction, so that a connection work can be easily performed avoiding obstructions of neighboring devices.

2. Background of the Related Art

Generally, diverse electrical devices are installed in a vehicle, and thus a means for supplying electricity to the electrical devices is required. Accordingly, an alternator which generates electricity when a vehicle engine starts is installed in the vehicle, and power is supplied to the various electrical devices.

However, if the vehicle engine rotates more than a predetermined number of times, more electricity than power consumption is generated, and if the engine stops or rotates at a low speed, the consumed power can be larger than the generated electricity. Accordingly, a storage battery is additionally installed in a vehicle in order to store surplus electricity and supplement lacking electricity.

The storage battery has two cylindrical post terminals of a (+) terminal and a (−) terminal, and connection terminals are used to safely withdraw power from the post terminals regardless of vibrations of the vehicle.

As shown in FIG. 1, a general storage battery connection terminal includes a power withdrawal unit 120 formed in a plate shape and provided with a connection hole of a predetermined size at the center, a connection bolt 130 inserted into the connection hole provided at the center of the power withdrawal unit 120, an insertion unit 140 provided at one side of the power withdrawal unit 120 and formed in a circular shape with an open side so as to insert a post terminal of a storage battery (not shown), and a clamping unit 150 formed at one side of the insertion unit 140 to be symmetrical in the horizontal direction.

The clamping unit 150 is provided with clamping holes at the front and rear in order to adjust the diameter of the insertion unit 140 using a clamping bolt 151 and a clamping nut 152. In addition, a hollow fixing drum is provided between the clamping bolt 151 and the clamping nut 152 in order to prevent excessive deformation of the insertion unit 140.

In addition, a storage battery connection terminal 100 of the prior art includes a connection terminal 170 where connection wires (not shown) connected in series or in parallel to supply power to the vehicle from the storage battery are installed. A connection hole where the connection bolt 130 is inserted is formed at one side of the connection terminal 170, and the fixing nut 131 is engaged with the connection bolt 130 and combined with the power withdrawal unit 120, in which the connection bolt 130 is projected passing through the connection hole of the connection terminal 170 with the intervention of a washer 132.

However, in the storage battery connection terminal 100 of the prior art, since the clamping bolt is positioned on the lateral side of the storage battery, workers suffer from difficulties in performing a connection work, and the workers are obstructed by other parts in the vehicle in using a clamping tool.

Storage battery connection terminals are developed in order to solve the obstruction problem, in which clamping bolts are installed in an inclined or vertical direction so that a work of coupling a clamping nut can be easily performed with a clamping tool, and these are disclosed in the patent documents listed below.

In addition, since most of storage battery connection terminals are formed of a panel, strength thereof is weak. Recently, the strength is improved by manufacturing the storage battery connection terminals using a forging method. The storage battery connection terminals of the forging method are disclosed in the patent documents described below.

(Patent document 1) KR20-0442760 Y1
(Patent document 2) KR10-0821591 B1
(Patent document 3) KR10-0821595 B1
(Patent document 4) KR10-1188637 B1

However, the storage battery connection terminals of the prior art are disadvantageous in that upper edges of a clamping bolt are damaged to prevent an engaged clamping nut from being loosened, and thus the clamping bolt is corroded.

In addition, since a power withdrawal unit is connected at the lower portion of the insertion unit in the conventional storage battery connection terminals of a forging method, clamping pressure is not evenly transferred to the insertion unit, and a saw-shaped latching projection is formed at the connection bolt in order to fix the connection bolt, and thus manufacturing cost of the connection bolt is increased.

SUMMARY OF THE INVENTION

Therefore, the present invention has been made in view of the above problems, and it is an object of the present invention to provide a storage battery connection terminal, in which a clamping nut can be easily coupled using a clamping tool, and corrosion of a clamping bolt can be prevented, and in addition, since the storage battery connection terminal is manufactured in a forging method, strength thereof is excellent.

In addition, another object of the present invention is to provide a storage battery connection terminal, in which clamping force can be evenly transferred to an insertion unit by changing the position of a power withdrawal unit, and a connection bolt can be tightly fixed without forming a latching projection at the connection bolt.

To accomplish the above object, according to one aspect of the present invention, there is provided a storage battery connection terminal comprising: an insertion unit of a cylindrical shape with an open end; a clamping unit for adjusting a diameter of the insertion unit by adjusting a gap between a pair of elastic pieces formed to be inclined along a radius direction from both ends of the insertion unit; and a power withdrawal unit connected at a position opposite to the open end of the insertion unit and connecting a connection terminal, in which the insertion unit, the elastic pieces of the clamping unit and the power withdrawal unit are formed in one piece through a forging process. The power withdrawal unit is connected at a position spaced apart from a lower portion of the insertion unit by a predetermined distance, in which a hole for inserting the connection bolt having a head of a rectangular panel shape is formed, and a resting groove with an open side is formed on a bottom surface so that a portion of the head of the connection bolt can be rest.

In addition, according to the storage battery connection terminal of the present invention, a plurality of clamping projections is formed on the inner surface of the insertion unit along a height direction at regular intervals.

In addition, according to the storage battery connection terminal of the present invention, a predetermined section of the insertion unit over a portion connecting the power withdrawal unit is removed so as to insert a front end of the connection terminal.

In addition, according to the storage battery connection terminal of the present invention, the insertion unit has an opening of an inclined direction, and the clamping unit includes a lower elastic piece connected to one end portion of the insertion unit to be inclined, an upper elastic piece connected to other end portion of the insertion unit to be inclined, a clamping bolt inserted from a bottom surface of the lower elastic piece and a clamping nut engaged with the clamping bolt on a top of the upper elastic piece and pressing the upper elastic piece.

In addition, according to the storage battery connection terminal of the present invention, the clamping bolt has a head of a rectangular shape, and a thick section formed at a portion where the lower elastic piece and the insertion unit are connected includes a rotation prevention wall contacting with the head to prevent rotation of the clamping bolt.

In addition, according to the storage battery connection terminal of the present invention, upper corners of the elastic piece are processed to be rounded.

In addition, according to the storage battery connection terminal of the present invention, a silicon coating layer is formed on an inner surface of the clamping nut.

In addition, according to the storage battery connection terminal of the present invention, the clamping unit includes: a first elastic piece connected to one end of the insertion unit, on which the clamping bolt is installed, a second elastic piece connected to the other end of the insertion unit and formed to have a width narrower than that of the first elastic piece, a clamping nut engaged with the clamping bolt and adjusting a gap between the first elastic piece and the second elastic piece, and a clamping washer for converting vertical movement of the clamping nut into horizontal movement of the second elastic piece.

In addition, according to the storage battery connection terminal of the present invention, the clamping bolt is combined with the first elastic piece in a forcedly inserting manner with the intervention of a rotation restriction piece so that the clamping bolt may not rotate after being inserted in a hole formed at the first elastic piece.

In addition, according to the storage battery connection terminal of the present invention, the clamping washer includes a cover unit for covering the first elastic piece and the second elastic piece and having a guide hole for inserting the clamping bolt, and a coupling unit bent downward from one end of the cover unit and having a coupling groove for combining an insertion projection prominently formed outside of the second elastic piece.

In addition, according to the storage battery connection terminal of the present invention, the guide hole contacts with the bottom surface of the clamping washer and has a small diameter portion having a diameter the same as that of the hole of the first elastic piece and a large diameter portion having a diameter larger than that of the hole of the first elastic piece, which are connected in one piece while being spaced apart from each other, and the diameter of the guide hole increases toward the top surface to have an inclined inner surface.

In addition, according to the storage battery connection terminal of the present invention, the clamping nut includes a washer-assembled nut 28*a* engaged with the clamping bolt and resting on a top surface of the clamping washer, and a tapered cone-shaped unit provided on a bottom surface of the washer-assembled nut, inserted in the guide hole of the clamping washer, and having a diameter decreasing downward.

Figure 1:
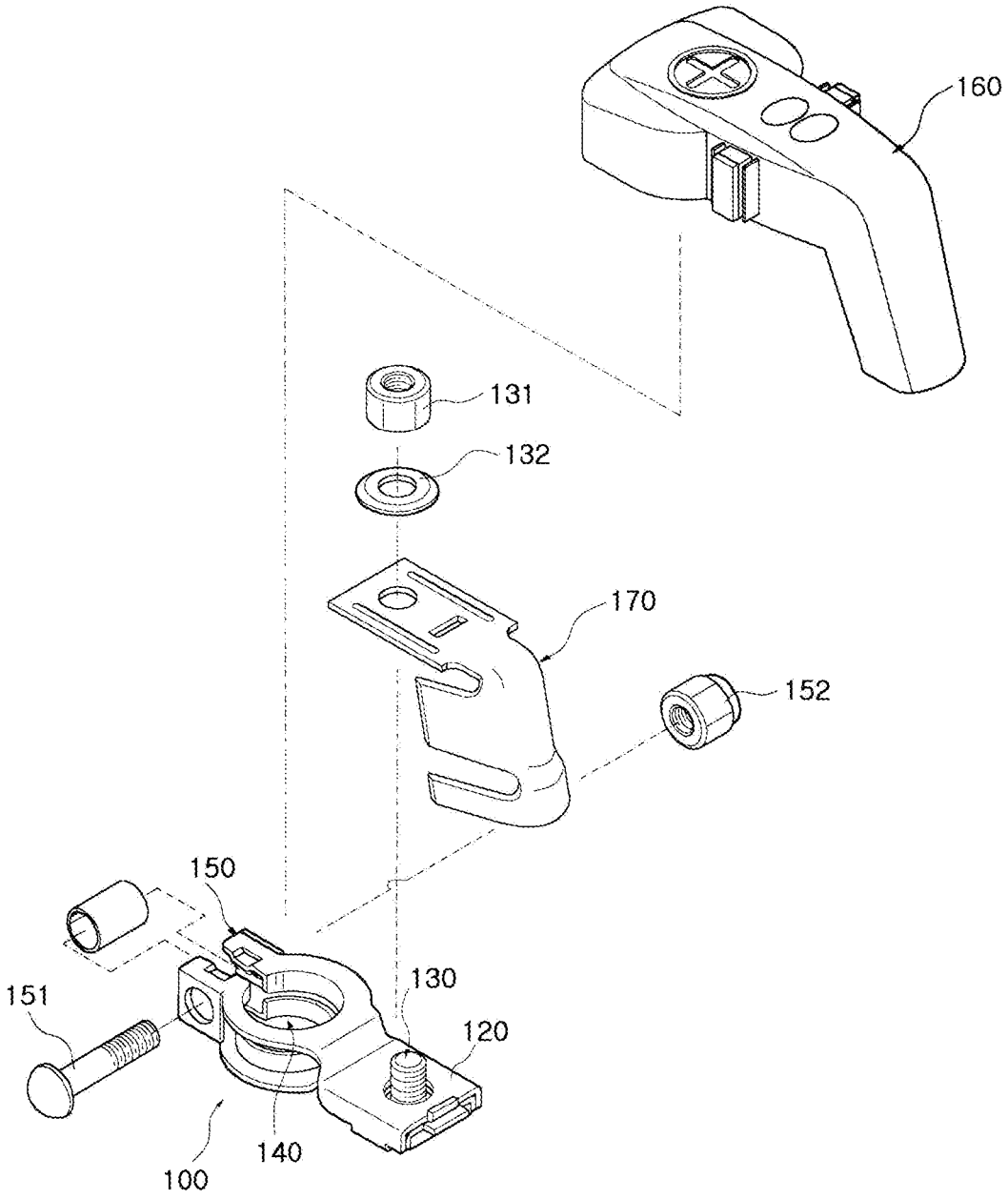
FIG. 1 (Prior Art)
FIG. 1 an exploded perspective view showing a storage battery connection terminal of the prior art.
Figure 2:
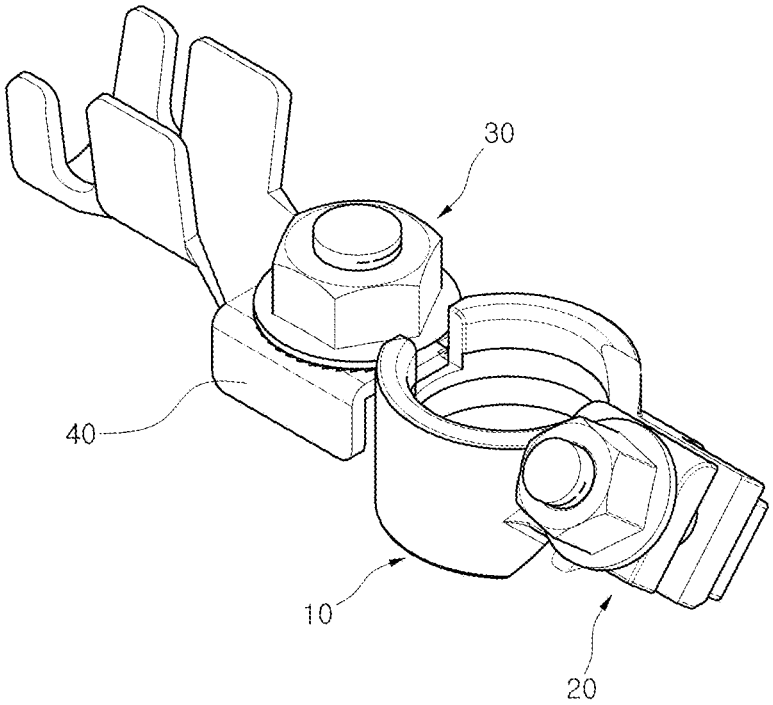
FIG. 2 is a perspective view showing a storage battery connection terminal according to the present invention.
Figure 3:
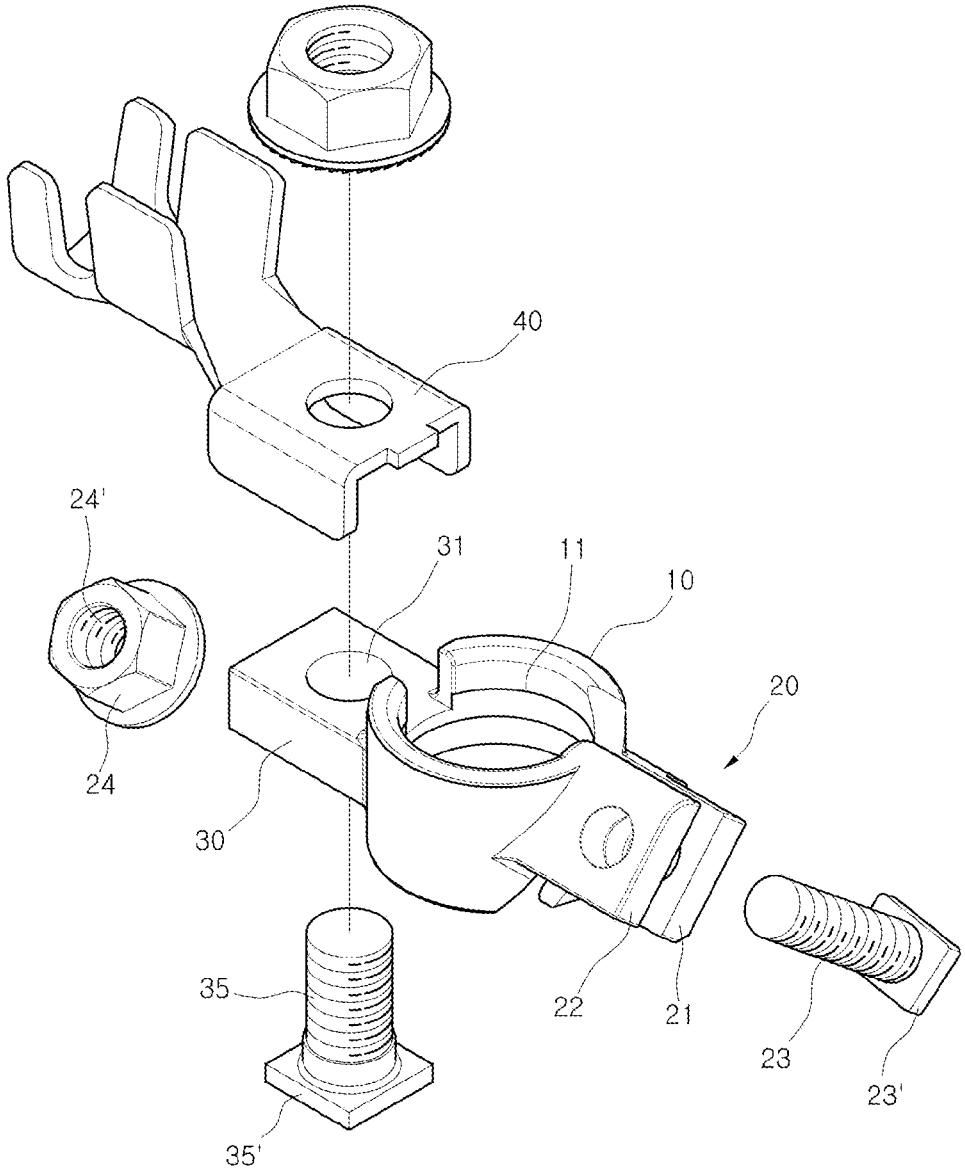
FIG. 3 an exploded perspective view showing a storage battery connection terminal of the present invention.
Figure 4:
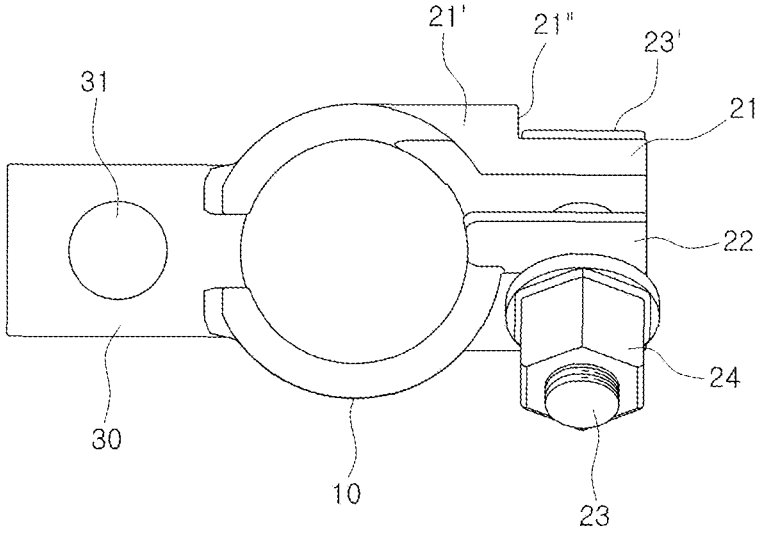
FIG. 4 a plan view showing a storage battery connection terminal of the present invention.
Figure 5:
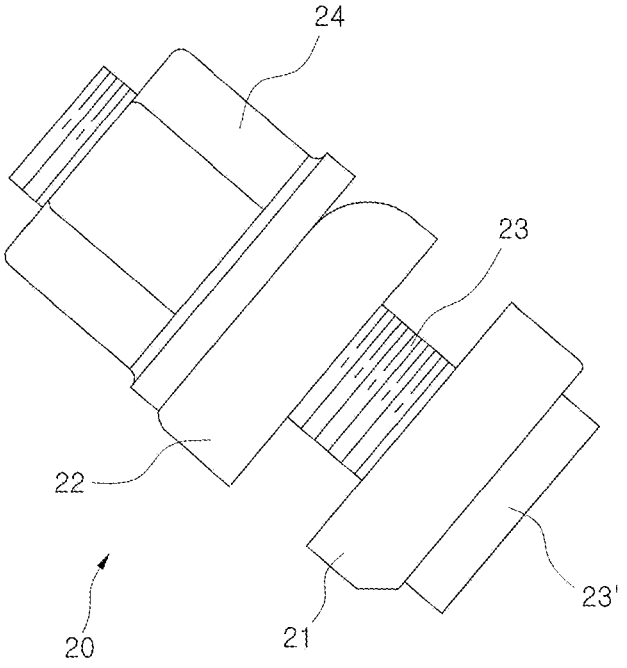
FIG. 5 is a side view showing a clamping unit which is an important part of the present invention.
Figure 6:
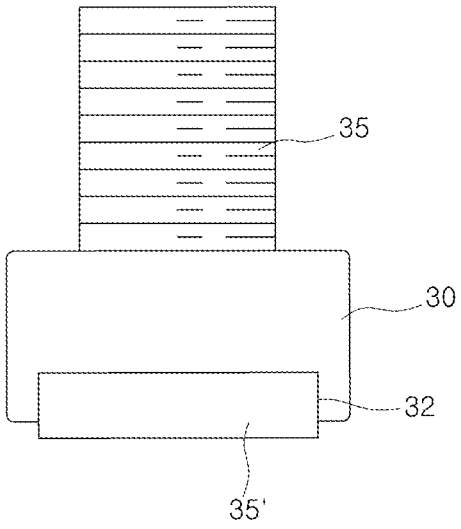
FIG. 6 is a side view showing a power withdrawal unit which is an important part of the present invention.
Figure 7:
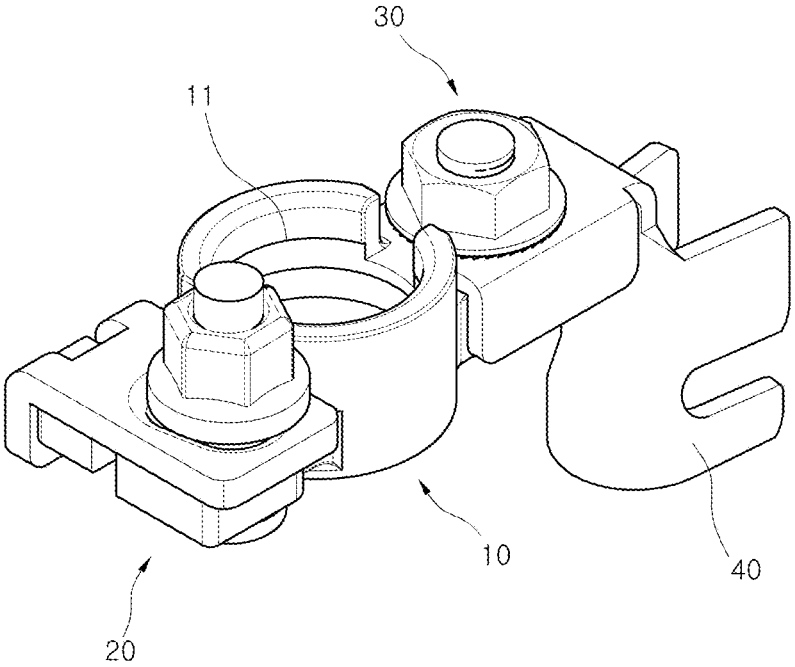
FIG. 7 is a perspective view showing another embodiment of the present invention.
Figure 8:
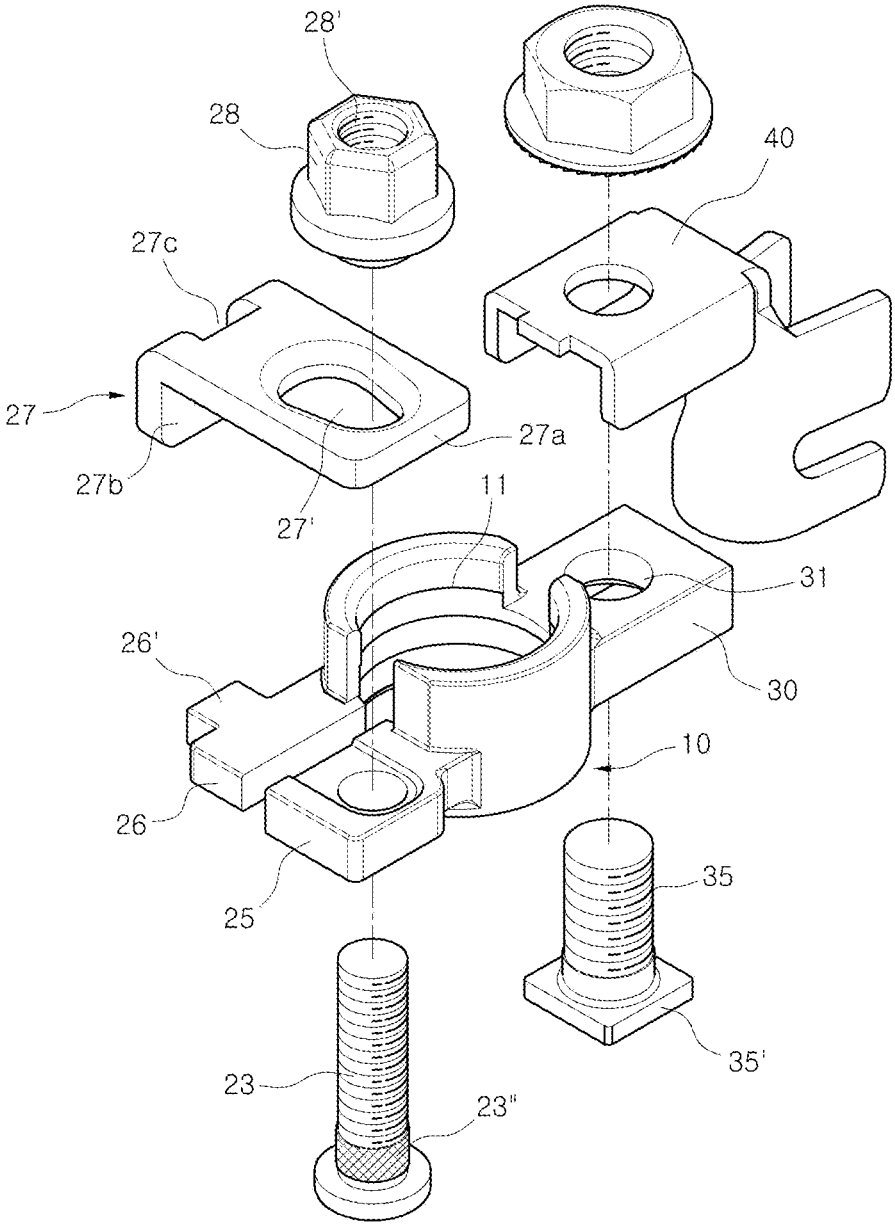
FIG. 8 is an exploded perspective view showing the storage battery connection terminal of FIG. 7.

| DESCRIPTION OF SYMBOLS | |
|---|---|
| 10: Insertion unit | 11: Clamping projection |
| 20: Clamping unit | 21: Lower elastic piece |
| 22: Upper elastic piece | 23: Clamping bolt |
| 23': Head | |
| 23'': Rotation restriction member | |
| 24: Clamping nut | |
| 24': Silicon coating layer | |
| 25: First elastic piece | |
| 26: Second elastic piece | 26': Insertion projection |
| 27: Clamping washer | 27': Guide hole |
| 27a: Cover unit | 27b: Coupling unit |
| 27c: Coupling groove | |
| 28: Clamping nut | |
| 28': Silicon coating layer | |
| 28a: Washer-assembled nut | 28b: Cone-shaped unit |
| 30: Power withdrawal unit | 32: Resting groove |
| 35: Connection bolt | 35': Head |

DETAILED DESCRIPTION OF THE PREFERRED EMBODIMENT

The storage battery connection terminal of the invention will be hereafter described in detail, with reference to the accompanying drawings.

As shown in FIGS. 2 to 6, a storage battery connection terminal according to the present invention includes an insertion unit 10 of a cylindrical shape with an open end; a clamping unit 20 for adjusting the diameter of the insertion unit 10 by adjusting a gap between a pair of elastic pieces 21 and 22 formed to be inclined along the radius direction from both ends of the insertion unit 10; and a power withdrawal unit connected at a position opposite to the open end of the insertion unit 10 and connecting a connection terminal 40, in which the insertion unit 20, the elastic pieces 21 and 22 of the clamping unit 20 and the power withdrawal unit 30 are formed in one piece through a forging process.

Here, the power withdrawal unit 30 is connected at a position spaced apart from a lower portion of the insertion unit 10 by a predetermined distance, in which a hole 31 for inserting the connection bolt 35 having a head 35' of a rectangular panel shape is formed, and a resting groove 32 with an open side is formed on the bottom surface so that a portion of the head 35' of the connection bolt 35 can be rest.

Accordingly, clamping pressure of the clamping unit is not concentrated only on the top of the insertion unit, but comparatively evenly acts upon all over the insertion unit. In addition, the connection bolt 35 is prevented from being rotated by vibration of a vehicle or the like, and since the connection bolt 35 is tightly fixed, cracks generated when the vehicle vibrates can be prevented, and electrical resistance can be reduced.

Furthermore, since the resting groove 32 can be formed in the process of forming the power withdrawal unit 30 through a forging process, a process of forming the resting groove 32 is not needed separately, and since a saw-shaped latching projection for preventing rotation of the connection bolt does not need to be formed, manufacturing cost of the connection bolt 35 can be reduced.

In addition, a plurality of clamping projections 11 is formed on the inner surface of the insertion unit 10 along the height direction at regular intervals. Accordingly, the rotation holding force and the retention force of the insertion unit 10 with respect to the post terminal of the storage battery are improved.

In addition, a predetermined section of the insertion unit 10 over the portion connecting the power withdrawal unit 30 is preferably removed so as to insert a front end of the connection terminal 40. This will make it easy to determine a position of the connection terminal 40 and works as a factor for increasing elasticity of the insertion unit 10.

Meanwhile, the insertion unit 10 has an opening of an inclined direction, and the clamping unit 20 includes a lower elastic piece 21 connected to one end portion of the insertion unit 10 to be inclined, an upper elastic piece 22 connected to other end portion of the insertion unit 10 to be inclined, a clamping bolt 23 inserted from the bottom surface of the lower elastic piece 21, and a clamping nut 24 engaged with the clamping bolt 23 on the top of the upper elastic piece 22 and pressing the upper elastic piece 22.

Since the upper elastic piece 22 and the lower elastic piece 21 are connected to be inclined respectively as described above, the clamping bolt 23 and the clamping nut 24 are installed in an inclined direction, and thus the clamping nut 24 can be connected from the inclined direction.

Here, the clamping bolt 23 has a head 23' of a rectangular shape, and a thick section 21' is formed at a portion where the lower elastic piece 21 and the insertion unit are connected, and in addition, one side of the thick section 21' contacts with the head 23' so as to act as a rotation prevention wall 21" for preventing rotation of the clamping bolt 23. Accordingly, the clamping bolt 23 does not rotate although a vehicle vibrates, and thus the clamping nut 24 can be prevented from being loosened.

In addition, a silicon nut formed with a silicon coating layer 24' on the inner surface is used as the clamping nut 24. If such a silicon nut is used, the clamping nut 24 is not easily loosened after being engaged with the clamping bolt 23. Accordingly, the clamping bolt 23 does not need to be damaged so as to be firmly engaged with the clamping nut 24, and durability is improved since the clamping bolt 23 is not corroded.

In addition, upper corners of the elastic piece 22 are processed to be rounded. Accordingly, damages from the upper corners of the elastic piece exposed to out side can be prevented.

The storage battery connection terminal of the present invention configured as described above reduces a gap between the upper elastic piece and a lower elastic piece and decreases the diameter of the insertion unit by engaging a clamping nut with a clamping bolt installed at an inclined-shape elastic piece, and thus the post terminal of the storage battery is fixed, and since the clamping nut is engaged from an inclined direction, obstructions of the other parts of a vehicle can be avoided when a connection work is performed using a clamping tool.

Meanwhile, as shown in FIGS. 7 to 11, a storage battery connection terminal according to another embodiment of the present invention includes an insertion unit 10 of a cylindrical shape with en open end; a clamping unit 20 for adjusting the diameter of the insertion unit 10 by adjusting a gap between a pair of elastic pieces 25 and 26 formed to be flat along the radius direction from both ends of the insertion unit 10; and a power withdrawal unit 30 connected at a position opposite to the opening end of the insertion unit 10 and connecting a connection terminal 40, in which the insertion unit 20, the elastic pieces 25 and 26 of the clamping unit 20 and the power withdrawal unit 30 are formed in one piece through a forging process.

Here, only the configuration of the clamping unit 20 is different from that of the storage battery connection terminal described above, and the structures of the insertion unit 10 and the power withdrawal unit 30 are the same as those of the storage battery connection terminal, and thus the configuration of the other parts except the clamping unit 20 will not be described.

The clamping unit 20 includes a first elastic piece 25 of horizontal direction connected to one end of the insertion unit 10, on which the clamping bolt 23 is installed, a second elastic piece 26 of horizontal direction connected to the other end of the insertion unit 10, installed and connected to be spaced apart from the first elastic piece 25 and formed to have a width narrower than that of the first elastic piece 25, a clamping nut 28 engaged with the clamping bolt 23 and adjusting a gap between the first elastic piece 25 and the second elastic piece 26, and a clamping washer 27 for converting vertical movement of the clamping nut 28 into horizontal movement of the second elastic piece 26.

Here, the clamping bolt 23 is preferably combined with the first elastic piece 25 in a forcedly inserting manner with the intervention of a rotation restriction piece 23" so that the clamping bolt 23 may not rotate after being inserted in a hole formed at the first elastic piece 25.

Figure 9:
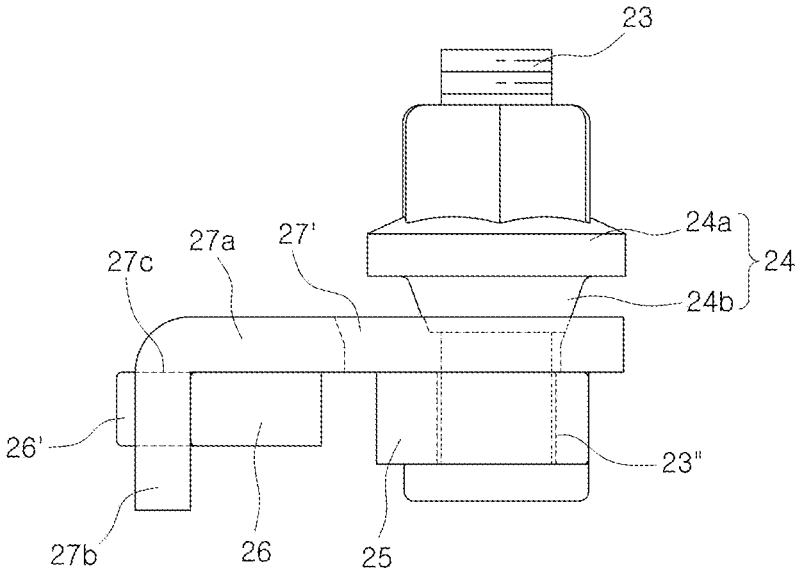
FIG. 9 is a side view showing the clamping unit which is an important part of FIG. 7.

In addition, as shown in FIG. 9, the clamping washer includes a cover unit 27*a* for covering the first elastic piece 25 and the second elastic piece 26 and having a guide hole 27' for inserting the clamping bolt 23, and a coupling unit 27*b* bent downward from one end of the cover unit 27*a* having a coupling groove 27*c* for combining an insertion projection 26' prominently formed outside of the second elastic piece 26.

Here, the guide hole 27' contacts with the bottom surface of the clamping washer 27, and it has a small diameter portion having a diameter the same as that of the hole of the first elastic piece 25 and a large diameter portion having a diameter larger than that of the hole of the first elastic piece 25, which are connected in one piece while being spaced apart from each other. The diameter of the guide hole 27' increases toward the top surface, and thus the inner surface is formed to be inclined.

Figure 10:
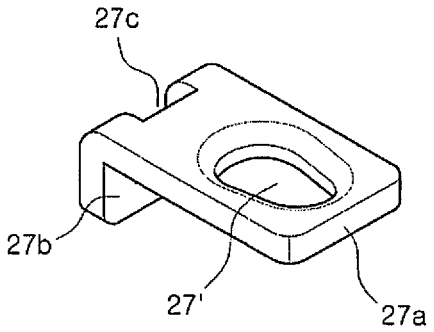
FIG. 10 is a perspective view and a side view showing the clamping washer which is an important part of FIG. 7.
Figure 10:
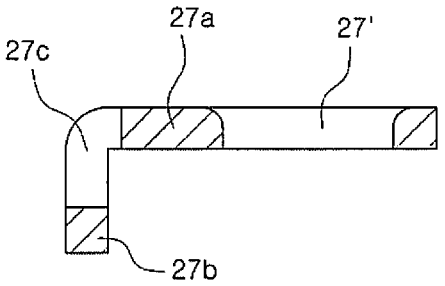
Figure 11:
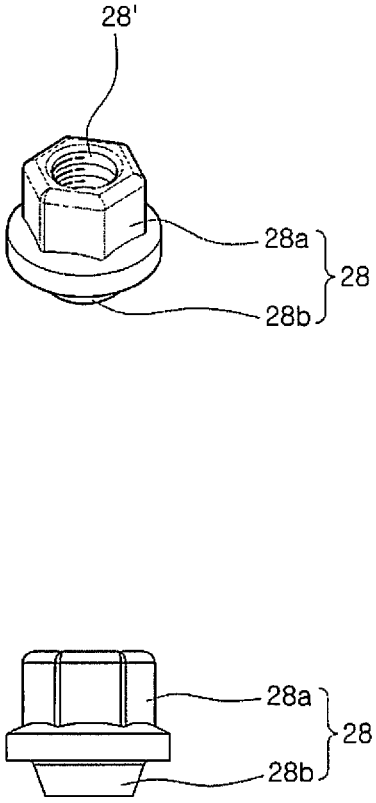
FIG. 11 is a perspective view and a side view showing the clamping unit which is an important part of FIG. 7.

In addition, as shown in FIG. 10, the clamping nut 28 includes a washer-assembled nut 28*a* engaged with the clamping bolt 23 and resting on the top surface of the clamping washer 27, and a tapered cone-shaped unit 28*b* provided on the bottom surface of the washer-assembled nut 28*a* and inserted in the guide hole 27' of the clamping washer 27, the diameter of which decreases downward. In addition, a silicon coating layer 28' is preferably formed on the inner surface of the clamping nut 28.

In another embodiment of the present invention configured as described above, the clamping nut is engaged with the clamping bolt installed at the first elastic piece with the intervention of the clamping washer, and the clamping washer moves in the horizontal direction as the clamping nut descends, and thus the second elastic piece moves toward the first elastic piece. Accordingly, the gap between the first elastic piece and the second elastic piece decreases, and thus the gap between the upper elastic piece and the lower elastic piece decreases. Therefore, the diameter of the insertion unit is decreased, and thus the post terminal of the storage battery is fixed. As described above, since the clamping nut is engaged from top direction, obstructions of the other parts of a vehicle can be avoided when a connection work is performed using a clamping tool.

The storage battery connection terminal of the present invention is effective in that since the insertion unit, the elastic pieces and the power withdrawal unit are formed in one piece through a forging process, strength thereof is excellent. In addition, since the power withdrawal unit is connected at a position spaced apart from a lower portion of the insertion unit, pressure is evenly applied upon all over the insertion unit when a clamping work is performed. Since the head of the connection bolt rests upon the resting groove formed at the power withdrawal unit, the storage battery is not shaken, and thus cracks generated by the vibration of a vehicle can be prevented, and electrical resistance can be reduced.

In addition, according to the storage battery connection terminal of the present invention, since a plurality of clamping projections are formed on the inner surface of the insertion unit, the holding force and the retention force of the insertion unit for the post terminal are improved.

In addition, according to the storage battery connection terminal of the present invention, since a predetermined upper section of the insertion unit connecting the power withdrawal unit is removed, elastic force of the insertion unit is improved, and it is easy to determine a position of the connection terminal.

In addition, according to the storage battery connection terminal of the present invention, since the upper elastic piece and the lower elastic piece are inclinedly connected to the opening of an inclined direction formed at the insertion unit and a clamping bolt and a clamping nut are installed in the elastic pieces, the clamping nut can be engaged from the inclined direction, and thus a clamping work is easy to perform, and obstructions of neighboring devices are minimized when the clamping work is performed. In addition, a layout of the devices in the neighborhood of the storage battery of a vehicle can be easily configured.

In addition, according to the storage battery connection terminal of the present invention, since a rotation prevention wall for preventing rotation of the clamping bolt is formed at a thick section that is formed at a portion where the lower elastic piece and the insertion unit are connected, rotation of the clamping bolt generated by the vibration of a vehicle is prevented, and thus the clamping nut can be prevented from being loosened.

In addition, according to the storage battery connection terminal of the present invention, since upper corners of the elastic piece are processed to be rounded, damages from angular corners can be prevented.

In addition, according to the storage battery connection terminal of the present invention, since a silicon coating layer is formed on the inner surface of the clamping nut, the clamping nut is not easily loosened, and thus the clamping bolt does not need to be damaged to prevent the clamping nut from being loosened. Therefore, corrosion of the clamping bolt is prevented, and thus durability thereof can be improved.

In addition, according to the storage battery connection terminal of the present invention, since the elastic pieces are connected to both ends of the insertion unit in the horizontal direction and the clamping washer changes the diameter of the insertion unit by converting vertical movement of the clamping nut into horizontal movement of the elastic pieces, a clamping work is easy to perform, and obstructions of neighboring devices are minimized when the clamping work is performed. In addition, a layout of the devices in the neighborhood of the storage battery of a vehicle can be easily configured.

In addition, according to the storage battery connection terminal of the present invention, since the clamping bolt is installed at the first elastic piece in a forcedly inserting manner with the intervention of a rotation restriction piece, rotation of the clamping bolt generated by the vibration of a vehicle is prevented, and thus the clamping nut can be prevented from being loosened.

In addition, according to the storage battery connection terminal of the present invention, since an insertion projection of the second elastic piece is combined with the coupling unit of the clamping washer, departure of the clamping washer can be prevented.

In addition, according to the storage battery connection terminal of the present invention, since a cone-shaped unit of the clamping nut contacts with the inclined inner surface of the guide hole formed at the clamping washer, the clamping washer moves in the horizontal direction when the clamping nut descends, and the gap between the first and second elastic pieces and the diameter of the insertion unit can be changed.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. In a storage battery connection terminal comprising:

an insertion unit of a cylindrical shape with an open end; a clamping unit for adjusting a diameter of the insertion unit by adjusting a gap between a pair of elastic pieces formed to be inclined along a radius direction from both ends of the insertion unit; and a power withdrawal unit connected at a position opposite to the open end of the insertion unit and connecting a connection terminal, wherein the insertion unit, the elastic pieces of the clamping unit and the power withdrawal unit are formed in one piece through a forging process, the power withdrawal unit is connected at a position spaced apart from a lower portion of the insertion unit by a predetermined distance, and the power withdrawal unit includes a hole for inserting the connection bolt having a head of a rectangular panel shape, and a resting groove with an open side on a bottom surface so that a portion of the head of the connection bolt can be rest.

2. The terminal according to claim 1, wherein a plurality of clamping projections is formed on an inner surface of the insertion unit along a height direction at regular intervals.

3. The terminal according to claim 1, wherein a predetermined section of the insertion unit over a portion connecting the power withdrawal unit is removed so as to insert a front end of the connection terminal.

4. The terminal according to claim 1, wherein the insertion unit has an opening of an inclined direction, and the clamping unit includes a lower elastic piece connected to one end portion of the insertion unit to be inclined, an upper elastic piece connected to other end portion of the insertion unit to be inclined, a clamping bolt inserted from a bottom surface of the lower elastic piece, and a clamping nut engaged with the clamping bolt on a top of the upper elastic piece and pressing the upper elastic piece.

5. The terminal according to claim 4, wherein the clamping bolt has a head of a rectangular shape, and a thick section formed at a portion where the lower elastic piece and the insertion unit are connected includes a rotation prevention wall contacting with the head to prevent rotation of the clamping bolt.

6. The terminal according to claim 4, wherein upper corners of the elastic plate are processed to be rounded.

7. The terminal according to claim 4, wherein a silicon coating layer is formed on an inner surface of the clamping nut.

8. The terminal according to claim 1, wherein the clamping unit includes: a first elastic piece connected to one end of the insertion unit, on which the clamping bolt is installed, a second elastic piece connected to the other end of the insertion unit and formed to have a width narrower than that of the first elastic piece, a clamping nut engaged with the clamping bolt and adjusting a gap between the first elastic piece and the second elastic piece, and a clamping washer for converting vertical movement of the clamping nut into horizontal movement of the second elastic piece.

9. The terminal according to claim 8, wherein the clamping bolt is combined with the first elastic piece in a forcedly inserting manner with the intervention of a rotation restriction piece so that the clamping bolt may not rotate after being inserted in a hole formed at the first elastic piece.

10. The terminal according to claim 8, wherein the clamping washer includes a cover unit for covering the first elastic piece and the second elastic piece and having a guide hole for inserting the clamping bolt, and a coupling unit bent downward from one end of the cover unit and having a coupling groove for combining an insertion projection prominently formed outside of the second elastic piece.

11. The terminal according to claim 10, wherein the guide hole contacts with the bottom surface of the clamping washer and has a small diameter portion having a diameter the same as that of the hole of the first elastic piece and a large diameter portion having a diameter larger than that of the hole of the first elastic piece, which are connected in one piece while being spaced apart from each other, and the diameter of the guide hole increases toward a top surface to have an inclined inner surface.

12. The terminal according to claim 8, wherein the clamping nut includes a washer-assembled nut engaged with the clamping bolt and resting on a top surface of the clamping washer, and a tapered cone-shaped unit provided on a bottom surface of the washer-assembled nut, inserted in the guide hole of the clamping washer, and having a diameter decreasing downward.

* * * * *